US009745694B2

(12) United States Patent
Leonard

(10) Patent No.: US 9,745,694 B2
(45) Date of Patent: Aug. 29, 2017

(54) TREATMENT OF FIBERS FOR IMPROVED DYEABILITY

(71) Applicant: ColorZen, LLC, New York, NY (US)

(72) Inventor: Tony M. Leonard, Mooresville, NC (US)

(73) Assignee: COLORZEN, LLC, New York, NY (US)

( * ) Notice: Subject to any disclaimer, the term of this patent is extended or adjusted under 35 U.S.C. 154(b) by 187 days.

(21) Appl. No.: 14/763,132

(22) PCT Filed: Jan. 25, 2013

(86) PCT No.: PCT/US2013/023180
§ 371 (c)(1),
(2) Date: Jul. 23, 2015

(87) PCT Pub. No.: WO2014/116230
PCT Pub. Date: Jul. 31, 2014

(65) Prior Publication Data

US 2015/0322624 A1 Nov. 12, 2015

(51) Int. Cl.

| | |
|---|---|
| ***D06P 3/00*** | (2006.01) |
| ***D06P 5/22*** | (2006.01) |
| ***D06P 3/60*** | (2006.01) |
| ***D06P 1/66*** | (2006.01) |
| ***D06M 13/463*** | (2006.01) |
| ***D06M 11/38*** | (2006.01) |

(Continued)

(52) U.S. Cl.
CPC ..... *D06P 5/225* (2013.01); *D06M 11/38* (2013.01); *D06M 13/463* (2013.01); *D06P 1/66* (2013.01); *D06P 1/6735* (2013.01); *D06P 3/60* (2013.01); *D06M 2101/06* (2013.01)

(58) Field of Classification Search
CPC ..... D06P 5/225; D06P 1/66; D06P 1/6735; D06M 13/463; D06M 11/38; D06M 2101/06
See application file for complete search history.

(56) References Cited

U.S. PATENT DOCUMENTS 3,046,076 A 7/1962 Upshur
4,392,260 A * 7/1983 Bensen ..... E03D 1/142 4/249
5,133,779 A 7/1992 Toepfl
(Continued)

FOREIGN PATENT DOCUMENTS

CN 101760962 A 6/2010
FR 2181448 A2 12/1973
(Continued)

OTHER PUBLICATIONS

International Search Report dated Apr. 1, 2013.
Japan Surfactant Industry Association database, Product 04000085 Clean N-15 040 Lion Specialties Chemicals Co. Ltd.

*Primary Examiner* — Eisa Elhilo
(74) *Attorney, Agent, or Firm* — Tarter Krinsky & Drogin LLP

(57) ABSTRACT

The present technology is directed to devices and methods for dyeing a fiber, including pretreatment of the fiber before contacting it with a dye. The present technology is also directed to methods of improving the dyeability of a fiber, as well as increasing the efficiency of the dyeing process and minimizing waste and loss of dye.

17 Claims, 21 Drawing Sheets

(51) Int. Cl.
*D06P 1/673* (2006.01)
*D06M 101/06* (2006.01)

(56) References Cited

U.S. PATENT DOCUMENTS

| | | | |
|---|---|---|---|
| 5,147,411 | A | 9/1992 | Toepfl |
| 5,489,313 | A | 2/1996 | Hall et al. |
| 5,667,533 | A | 9/1997 | Hauser |
| 5,815,867 | A | 10/1998 | Keasler |
| 5,833,720 | A | 11/1998 | Kent |
| 2008/0115695 | A1 | 5/2008 | Sujeeth et al. |
| 2008/0127430 | A1 | 6/2008 | Self |
| 2012/0088113 | A1 | 4/2012 | Heller et al. |
| 2012/0216356 | A1 | 8/2012 | Worner et al. |

FOREIGN PATENT DOCUMENTS

| | | |
|---|---|---|
| JP | 19910004459 | 1/1991 |
| JP | 2005060872 | 10/2005 |
| WO | 2011081907 | 7/2011 |

* cited by examiner

Shade Comparison of Different Dyeing - Everzol Navy ED

| Wavelength | 4% Conventional | 4% Exhaust | 4% Saturate/Store | 3% Saturate/Store | 2% Saturate/Store |
|---|---|---|---|---|---|
| 400 | 5.82 | 8.89 | 4.59 | 6.42 | 7.35 |
| 410 | 5.93 | 9.12 | 4.52 | 6.49 | 7.38 |
| 420 | 6.36 | 9.17 | 4.91 | 6.91 | 7.89 |
| 430 | 6.51 | 9.27 | 4.87 | 6.78 | 7.68 |
| 440 | 5.99 | 9.08 | 4.45 | 6.57 | 7.51 |
| 450 | 6.00 | 9.18 | 4.80 | 6.67 | 7.77 |
| 460 | 5.86 | 9.08 | 4.80 | 6.57 | 7.61 |
| 470 | 5.75 | 8.98 | 4.71 | 6.56 | 7.40 |
| 480 | 5.61 | 8.39 | 4.59 | 6.28 | 7.11 |
| 490 | 5.60 | 8.25 | 4.50 | 6.11 | 7.06 |
| 500 | 5.60 | 8.26 | 4.33 | 6.18 | 7.10 |
| 510 | 5.29 | 7.91 | 4.03 | 5.86 | 6.57 |
| 520 | 4.67 | 7.20 | 3.68 | 5.38 | 5.89 |
| 530 | 4.01 | 6.40 | 3.38 | 4.84 | 5.20 |
| 540 | 3.37 | 5.60 | 3.16 | 4.28 | 4.60 |
| 550 | 2.94 | 4.94 | 2.92 | 3.86 | 4.11 |
| 560 | 2.60 | 4.40 | 2.73 | 3.51 | 3.74 |
| 570 | 2.38 | 4.01 | 2.55 | 3.25 | 3.43 |
| 580 | 2.19 | 3.73 | 2.45 | 3.10 | 3.23 |
| 590 | 2.07 | 3.50 | 2.35 | 2.94 | 3.08 |
| 600 | 2.17 | 3.40 | 2.22 | 2.90 | 3.01 |
| 610 | 2.13 | 3.31 | 2.20 | 2.83 | 3.00 |
| 620 | 2.18 | 3.34 | 2.16 | 2.89 | 2.97 |
| 630 | 2.23 | 3.41 | 2.20 | 2.96 | 3.06 |
| 640 | 2.45 | 3.73 | 2.36 | 3.16 | 3.40 |
| 650 | 2.93 | 4.47 | 2.68 | 3.71 | 4.10 |
| 660 | 3.76 | 5.86 | 3.34 | 4.67 | 5.43 |
| 670 | 5.55 | 8.25 | 4.68 | 6.63 | 7.74 |
| 680 | 8.57 | 12.20 | 7.00 | 9.86 | 11.56 |
| 690 | 13.14 | 17.43 | 10.91 | 14.99 | 17.19 |
| 700 | 19.06 | 23.82 | 16.42 | 21.71 | 24.51 |

FIG. 1

Dye Bath / Rinses Conventional Reactive Dyeing - Everzol Navy ED 4%

| Wavelength | Dye Bath | Rinse 1 | Rinse 2 | Rinse 3 | Rinse 4 | Rinse 5 | Rinse 6 | Rinse 7 | Rinse 8 |
|---|---|---|---|---|---|---|---|---|---|
| 400 | 20.30 | 29.35 | 46.88 | 58.31 | 92.99 | 102.43 | 105.55 | 105.46 | 105.84 |
| 410 | 22.25 | 31.78 | 49.79 | 61.12 | 93.76 | 102.67 | 105.48 | 105.31 | 106.03 |
| 420 | 23.15 | 32.83 | 50.89 | 62.53 | 94.53 | 103.12 | 105.27 | 105.47 | 105.97 |
| 430 | 22.57 | 32.41 | 50.99 | 62.66 | 94.60 | 103.15 | 106.00 | 105.69 | 106.24 |
| 440 | 21.16 | 31.05 | 49.88 | 62.03 | 94.15 | 102.78 | 106.05 | 105.44 | 105.96 |
| 450 | 19.42 | 29.18 | 48.30 | 61.02 | 93.77 | 102.72 | 105.39 | 105.43 | 106.02 |
| 460 | 17.81 | 27.62 | 47.12 | 60.16 | 93.70 | 102.97 | 105.35 | 105.62 | 106.05 |
| 470 | 15.82 | 25.47 | 45.00 | 58.44 | 93.10 | 102.67 | 105.24 | 105.49 | 106.06 |
| 480 | 13.88 | 22.85 | 42.40 | 56.27 | 92.39 | 102.55 | 105.43 | 105.60 | 106.21 |
| 490 | 12.32 | 21.07 | 40.53 | 54.49 | 91.64 | 102.5 | 105.26 | 105.44 | 106.00 |
| 500 | 11.15 | 19.58 | 39.19 | 53.22 | 91.09 | 102.24 | 105.14 | 105.53 | 106.04 |
| 510 | 9.42 | 16.80 | 35.70 | 50.35 | 90.06 | 102.00 | 105.00 | 105.39 | 105.96 |
| 520 | 6.84 | 12.79 | 29.94 | 45.13 | 87.96 | 101.39 | 104.62 | 105.20 | 105.74 |
| 530 | 4.53 | 8.93 | 23.89 | 39.13 | 85.55 | 100.83 | 104.46 | 105.20 | 105.94 |
| 540 | 2.96 | 5.93 | 18.46 | 33.08 | 82.60 | 100.06 | 104.38 | 105.09 | 105.86 |
| 550 | 1.81 | 3.91 | 14.02 | 27.47 | 79.42 | 99.15 | 104.12 | 104.95 | 105.67 |
| 560 | 1.19 | 2.60 | 10.54 | 22.84 | 76.62 | 98.40 | 103.78 | 104.85 | 105.74 |
| 570 | 0.78 | 1.70 | 7.92 | 19.11 | 73.73 | 97.60 | 103.44 | 104.70 | 105.55 |
| 580 | 0.64 | 1.31 | 6.66 | 16.87 | 71.83 | 97.07 | 103.33 | 104.72 | 105.77 |
| 590 | 0.69 | 1.39 | 6.35 | 16.06 | 70.93 | 96.72 | 103.15 | 104.62 | 105.56 |
| 600 | 1.00 | 1.80 | 6.71 | 16.51 | 71.12 | 96.66 | 103.05 | 104.54 | 105.60 |
| 610 | 1.36 | 2.21 | 7.55 | 17.65 | 72.06 | 96.94 | 103.25 | 104.63 | 105.65 |
| 620 | 1.99 | 2.97 | 9.35 | 19.93 | 73.95 | 97.50 | 103.41 | 104.58 | 105.56 |
| 630 | 3.12 | 4.45 | 12.98 | 24.42 | 77.26 | 98.50 | 103.65 | 104.81 | 105.68 |
| 640 | 5.63 | 8.05 | 20.08 | 32.48 | 82.09 | 99.76 | 104.03 | 104.87 | 105.61 |
| 650 | 10.66 | 15.09 | 31.72 | 44.20 | 87.94 | 101.46 | 104.68 | 105.31 | 105.87 |
| 660 | 20.01 | 26.87 | 47.10 | 58.46 | 93.32 | 102.67 | 104.87 | 105.29 | 105.81 |
| 670 | 33.84 | 42.52 | 63.52 | 72.54 | 97.77 | 103.77 | 105.37 | 105.59 | 105.99 |
| 680 | 50.24 | 59.08 | 77.69 | 84.18 | 100.88 | 104.56 | 105.63 | 105.75 | 105.92 |
| 690 | 66.36 | 73.98 | 88.36 | 92.64 | 102.82 | 105.00 | 105.66 | 105.70 | 105.89 |
| 700 | 79.44 | 85.09 | 95.21 | 97.87 | 103.77 | 105.07 | 105.61 | 105.59 | 105.80 |

Fig 3. – Transmittance Values for Conventional Reactive Dye Bath and Sequential Rinse Baths of Fabric Made With Untreated Cotton Fiber and Dyed with Conventional Reactive Dyeing Procedure

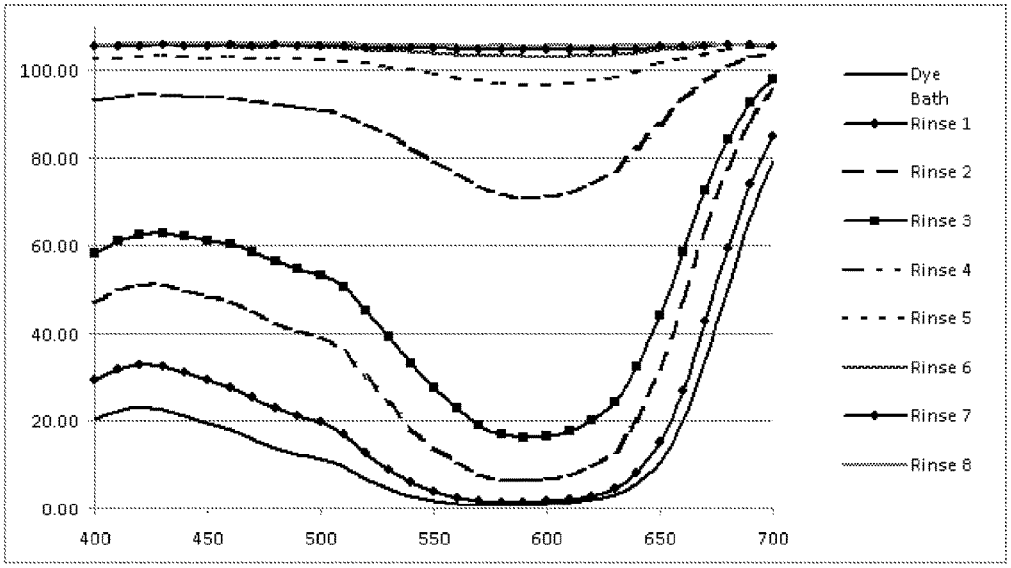
Fig. 4: Each Sequential Rinse of Fabric Made With Untreated Cotton Fiber and Dyed with a Conventional Reactive Dyeing Procedure

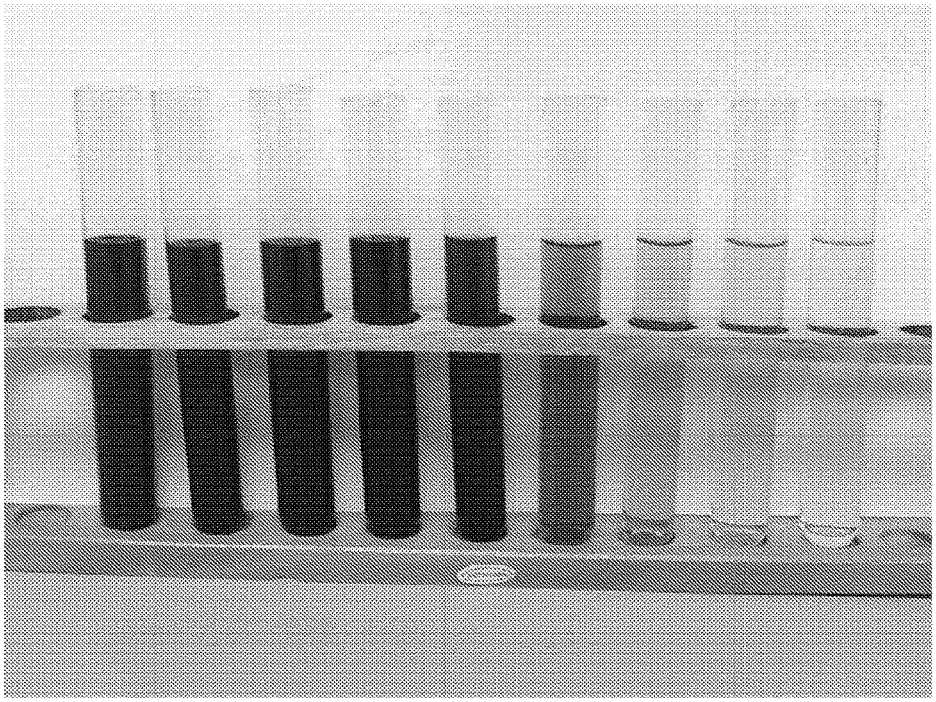
Fig. 5 – From left to right, samples of dye bath and sequential rinse baths of untreated cotton fabric dyed with a conventional reactive dye procedure. 4% Everzol Navy ED

Dye Bath / Rinses Exhaust Pretreatment - Everzol Navy ED 4%

| Wavelength | Dye Bath | Rinse 1 | Rinse 2 | Rinse 3 | Rinse 4 | Rinse 5 | Rinse 6 |
|---|---|---|---|---|---|---|---|
| 400 | 0.27 | 17.55 | 68.52 | 100.15 | 103.87 | 104.27 | 104.59 |
| 410 | 0.27 | 20.38 | 71.12 | 101.05 | 104.04 | 104.28 | 104.61 |
| 420 | 0.32 | 21.19 | 71.91 | 101.23 | 104.31 | 104.62 | 104.92 |
| 430 | 0.33 | 21.15 | 71.74 | 101.06 | 104.32 | 104.92 | 105.27 |
| 440 | 0.25 | 20.37 | 71.14 | 100.98 | 104.02 | 104.80 | 105.13 |
| 450 | 0.36 | 19.43 | 69.98 | 100.73 | 103.84 | 104.76 | 105.21 |
| 460 | 0.19 | 18.61 | 69.68 | 100.76 | 104.02 | 105.00 | 105.38 |
| 470 | 0.16 | 16.97 | 68.35 | 100.42 | 103.85 | 104.96 | 105.46 |
| 480 | 0.19 | 15.19 | 66.67 | 100.00 | 103.90 | 105.19 | 105.56 |
| 490 | 0.11 | 14.62 | 66.22 | 99.99 | 103.71 | 105.06 | 105.44 |
| 500 | 0.07 | 13.71 | 65.49 | 99.82 | 103.66 | 105.24 | 105.60 |
| 510 | 0.08 | 10.91 | 62.19 | 99.15 | 103.50 | 105.05 | 105.44 |
| 520 | 0.03 | 7.41 | 56.65 | 97.64 | 102.77 | 104.85 | 105.19 |
| 530 | 0.03 | 4.48 | 50.38 | 96.24 | 102.30 | 104.69 | 105.27 |
| 540 | 0.04 | 2.55 | 44.11 | 94.55 | 101.51 | 104.45 | 105.06 |
| 550 | 0.01 | 1.28 | 37.88 | 92.52 | 100.63 | 104.15 | 104.86 |
| 560 | 0.02 | 0.65 | 32.36 | 90.52 | 99.87 | 103.94 | 104.67 |
| 570 | 0.01 | 0.32 | 27.79 | 88.60 | 98.89 | 103.59 | 104.45 |
| 580 | 0.01 | 0.12 | 24.75 | 87.31 | 98.42 | 103.40 | 104.34 |
| 590 | 0.01 | 0.09 | 23.08 | 86.39 | 97.95 | 103.21 | 104.20 |
| 600 | 0.01 | 0.06 | 22.75 | 86.15 | 97.73 | 103.11 | 104.08 |
| 610 | 0.01 | 0.03 | 23.7 | 86.61 | 98.02 | 103.20 | 104.12 |
| 620 | 0.01 | 0.19 | 27.11 | 88.17 | 98.57 | 103.47 | 104.30 |
| 630 | 0.01 | 0.78 | 34.22 | 90.93 | 99.89 | 103.90 | 104.61 |
| 640 | 0.01 | 3.12 | 45.77 | 94.49 | 101.28 | 104.37 | 104.88 |
| 650 | 0.01 | 10.12 | 60.30 | 98.45 | 103.05 | 105.22 | 105.54 |
| 660 | 0.86 | 24.98 | 74.76 | 101.20 | 104.08 | 105.38 | 105.58 |
| 670 | 6.35 | 46.14 | 86.54 | 103.35 | 105.12 | 105.83 | 105.96 |
| 680 | 21.37 | 67.09 | 94.57 | 104.61 | 105.59 | 105.90 | 105.93 |
| 690 | 44.29 | 77.96 | 99.29 | 105.29 | 105.74 | 105.93 | 105.95 |
| 700 | 66.32 | 93.10 | 101.01 | 105.45 | 105.72 | 105.88 | 105.86 |

Fig. 6 - Transmittance Values for Exhaust Pretreatment Dye Bath and Sequential Rinse Baths of Fabric Made with Exhaust Pretreated Fiber and Dyed Using "No Chemical" Dye Procedure

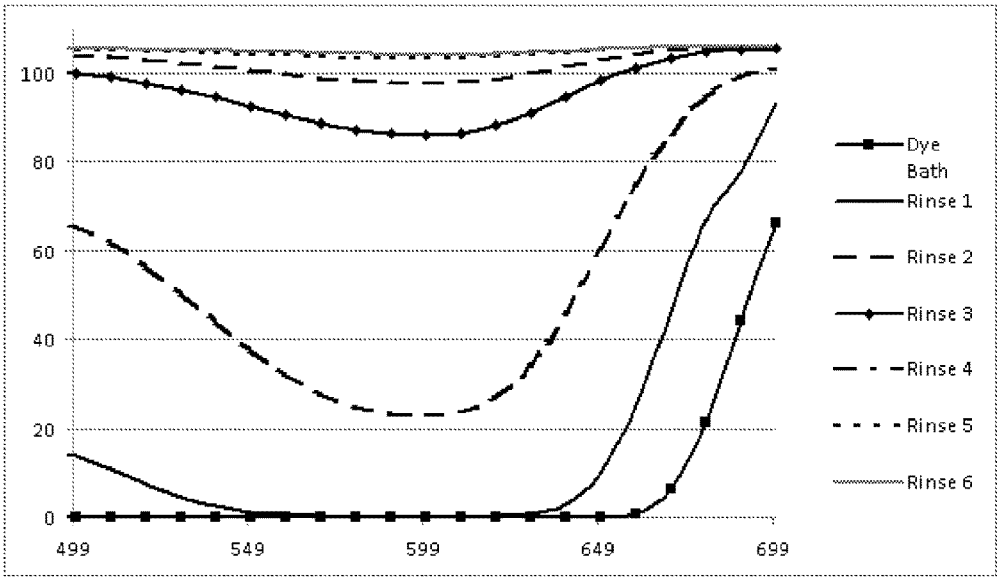
Fig. 7 – Graphic Representation of the Reduction of Color from Dye Bath and each Sequential Rinse of Fabric Made with Exhaust Pretreated Fiber and Dyed Using "No Chemical" Dye Procedure.

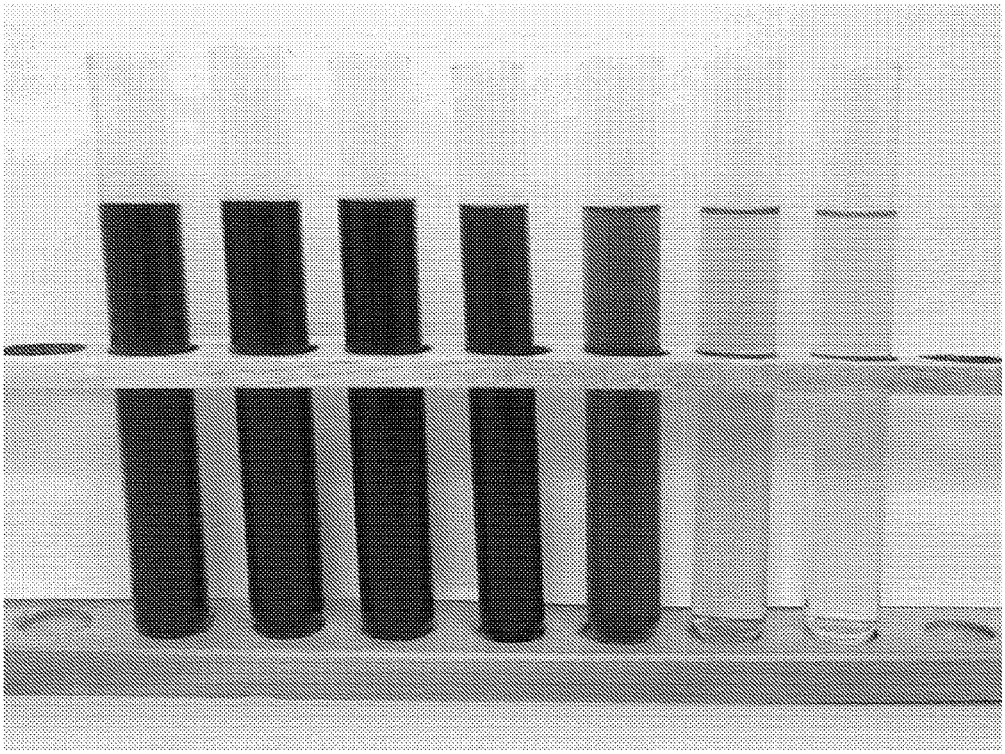
Fig 8 - From left to right, samples of dye bath and sequential rinse baths of exhaust pretreated cotton fabric dyed with a "no chemical" dye procedure. 4% Everzol Navy ED

Dye Bath / Rinses - Saturate/Store Fiber Pretreatment - 4% Everzol Navy ED

| Wavelength | Dye Bath | Rinse 1 | Rinse 2 | Rinse 3 |
|---|---|---|---|---|
| 400 | 38.27 | 90.24 | 103.41 | 105.47 |
| 410 | 41.85 | 91.51 | 103.60 | 105.56 |
| 420 | 43.18 | 91.98 | 103.80 | 105.60 |
| 430 | 43.14 | 92.08 | 103.85 | 105.94 |
| 440 | 42.43 | 91.97 | 103.60 | 105.67 |
| 450 | 41.83 | 91.91 | 103.58 | 105.58 |
| 460 | 41.02 | 92.04 | 103.82 | 105.74 |
| 470 | 39.28 | 91.70 | 103.68 | 105.77 |
| 480 | 37.07 | 91.18 | 103.90 | 105.88 |
| 490 | 36.44 | 90.85 | 103.76 | 105.68 |
| 500 | 35.30 | 90.65 | 103.77 | 105.78 |
| 510 | 31.55 | 89.37 | 103.84 | 105.64 |
| 520 | 25.69 | 87.00 | 103.47 | 105.36 |
| 530 | 19.98 | 84.48 | 103.34 | 105.42 |
| 540 | 15.08 | 81.46 | 103.00 | 105.27 |
| 550 | 10.98 | 78.05 | 102.44 | 105.06 |
| 560 | 7.79 | 74.89 | 102.15 | 104.90 |
| 570 | 5.65 | 71.97 | 101.61 | 104.74 |
| 580 | 4.30 | 69.91 | 101.52 | 104.65 |
| 590 | 3.66 | 68.66 | 101.27 | 104.52 |
| 600 | 3.57 | 68.45 | 101.03 | 104.41 |
| 610 | 3.89 | 69.38 | 101.38 | 104.50 |
| 620 | 5.36 | 71.92 | 101.69 | 104.53 |
| 630 | 9.08 | 76.77 | 102.48 | 104.86 |
| 640 | 17.18 | 83.28 | 103.26 | 105.09 |
| 650 | 31.46 | 90.12 | 104.29 | 105.61 |
| 660 | 50.41 | 95.77 | 104.73 | 105.72 |
| 670 | 69.35 | 99.89 | 105.37 | 106.04 |
| 680 | 84.04 | 102.42 | 105.65 | 106.01 |
| 690 | 93.66 | 103.94 | 105.66 | 106.03 |
| 700 | 98.95 | 104.44 | 105.60 | 105.92 |

Fig. 9 - Transmittance Values for Dye Bath and Sequential Rinse Baths of Fabric Made with Saturated / Stored Pretreated Fiber and Dyed Using "No Chemical" Dye Procedure

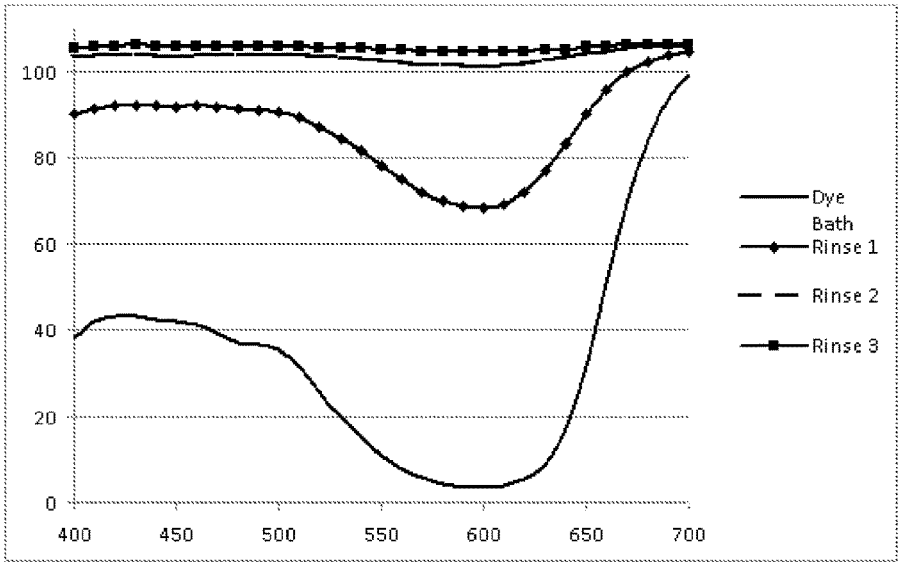
Fig. 10 – Graphic Representation of the Reduction of Color from Dye Bath and each Sequential Rinse of Fabric Made with Saturated / Stored Pretreated Fiber and Dyed Using "No Chemical" Dye Procedure

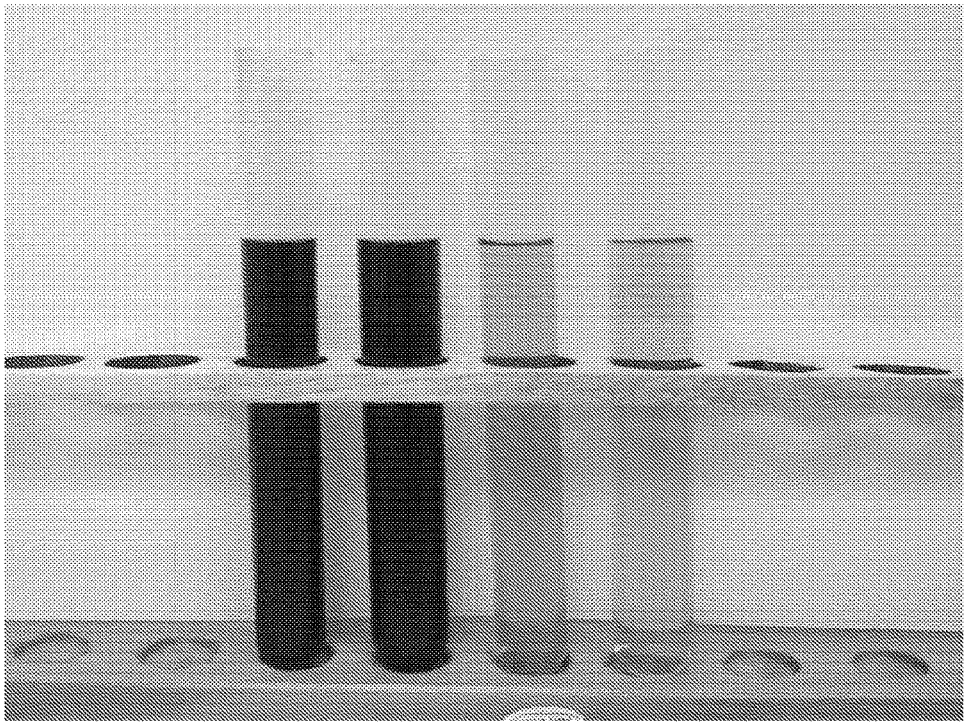
Fig. 11 - From left to right, samples of dye bath and sequential rinse baths of saturate/storepretreated cotton fabric dyed with a "no chemical" dye procedure. 4% Everzol Navy ED

Dye Bath / Rinses - Saturate/Store Fiber Pretreatment - 3% Everzol Navy ED

| Wavelength | Dye Bath | Rinse 1 | Rinse 2 |
|---|---|---|---|
| 400 | 78.98 | 102.74 | 105.94 |
| 410 | 81.25 | 102.86 | 105.78 |
| 420 | 82.10 | 103.14 | 105.86 |
| 430 | 82.09 | 103.25 | 106.12 |
| 440 | 81.92 | 103.00 | 105.93 |
| 450 | 81.81 | 103.02 | 105.89 |
| 460 | 81.67 | 103.51 | 106.03 |
| 470 | 81.01 | 103.34 | 106.11 |
| 480 | 80.16 | 103.63 | 106.30 |
| 490 | 79.84 | 103.45 | 106.10 |
| 500 | 79.49 | 103.52 | 106.19 |
| 510 | 77.74 | 103.60 | 106.09 |
| 520 | 74.23 | 103.21 | 105.89 |
| 530 | 70.49 | 103.25 | 106.08 |
| 540 | 66.35 | 103.01 | 106.05 |
| 550 | 62.17 | 102.60 | 105.89 |
| 560 | 58.03 | 102.50 | 105.91 |
| 570 | 54.18 | 102.09 | 105.80 |
| 580 | 51.35 | 102.11 | 105.92 |
| 590 | 49.74 | 101.85 | 105.74 |
| 600 | 49.51 | 101.86 | 105.74 |
| 610 | 50.61 | 101.99 | 105.73 |
| 620 | 53.91 | 102.16 | 105.67 |
| 630 | 60.36 | 102.73 | 105.82 |
| 640 | 69.64 | 103.19 | 105.75 |
| 650 | 79.92 | 103.94 | 106.06 |
| 660 | 88.90 | 104.18 | 105.98 |
| 670 | 95.70 | 104.62 | 106.11 |
| 680 | 99.82 | 104.83 | 106.00 |
| 690 | 102.24 | 104.91 | 105.96 |
| 700 | 103.31 | 104.72 | 105.84 |

Fig. 12 - Transmittance Values for Dye Bath and Sequential Rinse Baths of Fabric Made with Saturated / Stored Pretreated Fiber and Dyed Using "No Chemical" Dye Procedure and 25% Reduction of Dye and 25% Reduction of Dye

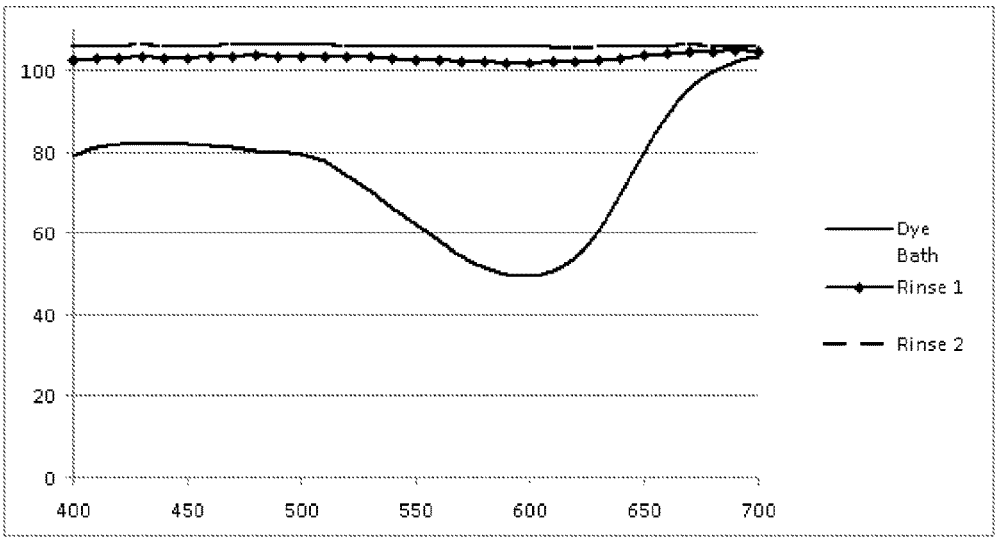
Fig. 13 – Graphic Representation of the Reduction of Color from the Dye Bath and each Sequential Rinse of Fabric Made with Saturated / Stored Pretreated Fiber and Dyed Using "No Chemical" Dye Procedure and 25% Reduction of Dye

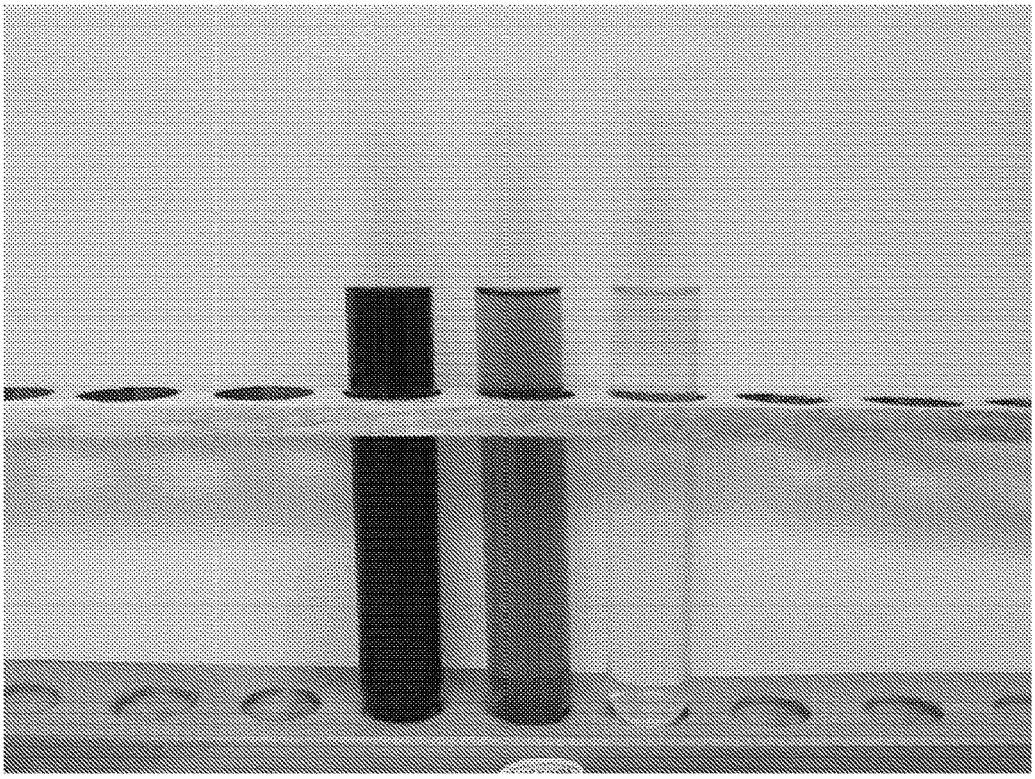
Fig. 14 - From left to right, samples of dye bath and sequential rinse baths of saturate/store pretreated cotton fabric dyed with a "no chemical" dye procedure. 3% Everzol Navy ED (25% reduction)

Dye Bath / Saturate/Store Fiber Pretreatment - 2 % Everzol Navy ED

| Wavelength | Dye Bath |
|---|---|
| 400 | 99.73 |
| 410 | 99.86 |
| 420 | 99.95 |
| 430 | 99.88 |
| 440 | 99.85 |
| 450 | 99.96 |
| 460 | 99.88 |
| 470 | 99.92 |
| 480 | 99.82 |
| 490 | 100.00 |
| 500 | 99.85 |
| 510 | 99.91 |
| 520 | 99.91 |
| 530 | 99.93 |
| 540 | 100.04 |
| 550 | 100.00 |
| 560 | 99.89 |
| 570 | 99.89 |
| 580 | 99.89 |
| 590 | 99.91 |
| 600 | 99.92 |
| 610 | 99.90 |
| 620 | 99.93 |
| 630 | 99.97 |
| 640 | 99.98 |
| 650 | 99.99 |
| 660 | 99.99 |
| 670 | 100.05 |
| 680 | 100.05 |
| 690 | 100.06 |
| 700 | 100.02 |

Fig. 15 - Transmittance Values for Dye Bath and Sequential Rinse Baths of Fabric Made with Saturated / Stored Pretreated Fiber and Dyed Using "No Chemical" Dye Procedure and 50% Reduction of Dye

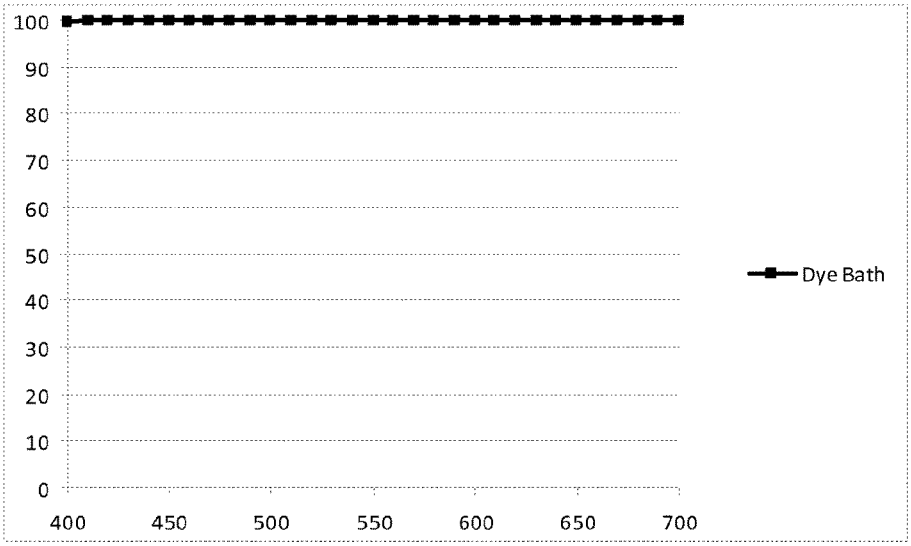
Fig. 16 – Graphic Representation of the Reduction of Color from the Dye Bath and each Sequential Rinse of Fabric Made with Saturated / Stored Pretreated Fiber and Dyed Using "No Chemical" Dye Procedure and 50% Reduction of Dye

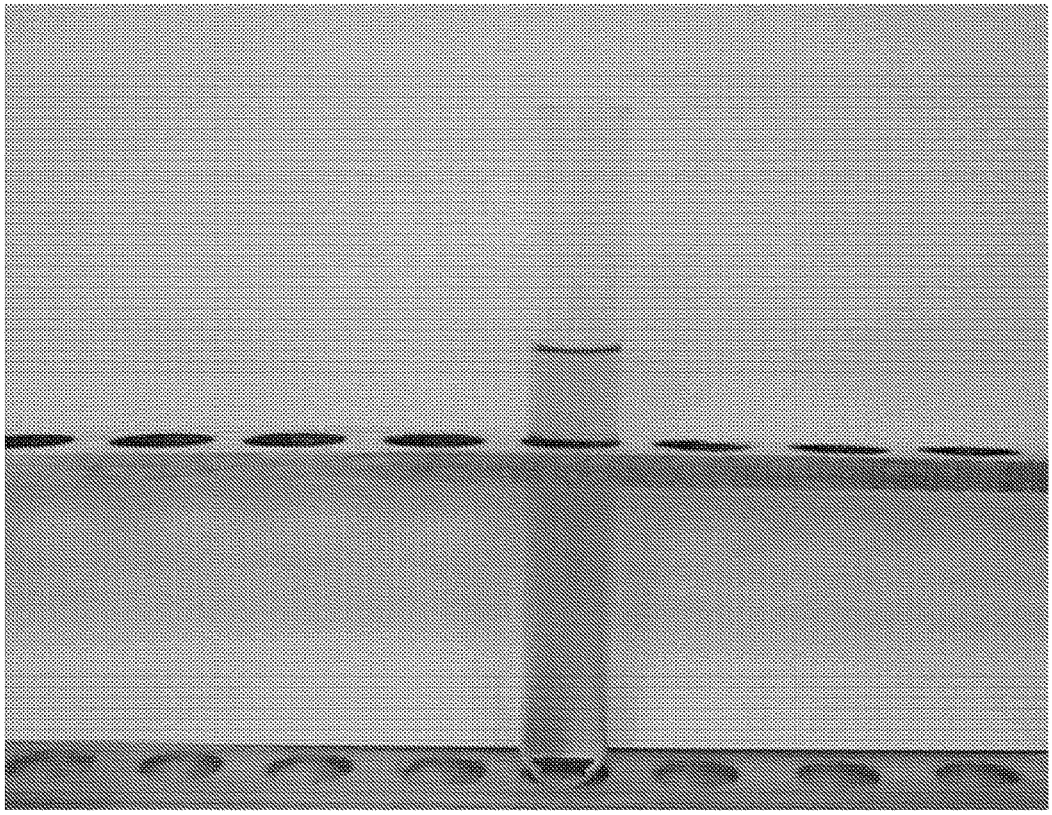
Fig. 17 - Dye bath of saturate/store pretreated cotton fabric dyed with a "no chemical" dye procedure. 2% Everzol Navy ED (50% reduction)

Comparison of Residual Color in Each Dye Bath

| Wavelength | Initial Dye | Conventional | Exhaust | Sat/Store 4% | Sat/Store 3% | Sat/Store 2% |
|---|---|---|---|---|---|---|
| 400 | 39.39 | 86.27 | 47.58 | 94.45 | 97.85 | 99.73 |
| 410 | 42.65 | 87.43 | 50.88 | 95.08 | 97.86 | 99.86 |
| 420 | 43.86 | 87.83 | 51.88 | 95.51 | 98.12 | 99.95 |
| 430 | 43.63 | 87.80 | 51.61 | 95.88 | 98.12 | 99.88 |
| 440 | 42.91 | 86.97 | 50.76 | 95.60 | 97.69 | 99.85 |
| 450 | 41.88 | 85.63 | 49.61 | 95.13 | 97.61 | 99.96 |
| 460 | 40.99 | 85.08 | 48.69 | 95.34 | 97.95 | 99.88 |
| 470 | 39.00 | 83.86 | 46.74 | 94.69 | 97.72 | 99.92 |
| 480 | 36.90 | 82.63 | 44.64 | 94.52 | 98.07 | 99.82 |
| 490 | 35.93 | 81.49 | 43.96 | 94.36 | 97.88 | 100.00 |
| 500 | 34.30 | 80.44 | 42.64 | 93.99 | 97.83 | 99.85 |
| 510 | 30.51 | 78.71 | 38.42 | 92.81 | 97.78 | 99.91 |
| 520 | 24.77 | 75.64 | 32.19 | 90.67 | 97.36 | 99.91 |
| 530 | 19.10 | 71.76 | 25.73 | 88.47 | 97.15 | 99.93 |
| 540 | 14.16 | 67.90 | 19.19 | 85.82 | 96.73 | 100.04 |
| 550 | 10.15 | 64.13 | 14.90 | 82.77 | 96.09 | 100.00 |
| 560 | 7.25 | 60.71 | 11.07 | 79.93 | 95.68 | 99.89 |
| 570 | 5.19 | 57.96 | 8.19 | 77.26 | 95.28 | 99.89 |
| 580 | 3.97 | 56.91 | 6.60 | 75.28 | 94.84 | 99.89 |
| 590 | 3.42 | 57.85 | 5.76 | 74.11 | 94.58 | 99.91 |
| 600 | 3.21 | 60.09 | 5.58 | 73.86 | 94.53 | 99.92 |
| 610 | 3.55 | 62.76 | 6.09 | 74.70 | 94.71 | 99.90 |
| 620 | 4.82 | 65.43 | 7.83 | 77.04 | 95.19 | 99.93 |
| 630 | 8.01 | 69.15 | 12.34 | 81.24 | 96.06 | 99.97 |
| 640 | 15.32 | 74.05 | 21.58 | 86.86 | 97.03 | 99.98 |
| 650 | 28.19 | 80.42 | 36.54 | 92.75 | 98.23 | 99.99 |
| 660 | 46.00 | 86.66 | 54.99 | 97.37 | 98.83 | 100.99 |
| 670 | 64.79 | 92.53 | 72.67 | 100.85 | 100.58 | 102.05 |
| 680 | 80.24 | 97.12 | 86.04 | 102.89 | 102.85 | 104.05 |
| 690 | 90.85 | 100.38 | 94.62 | 104.11 | 104.10 | 104.06 |
| 700 | 97.30 | 100.40 | 99.42 | 104.52 | 104.89 | 105.02 |

Fig. 18 – Transmittance Values for the Initial Dye Concentration and the Residual Dye Baths of Fabric made with Untreated Cotton Fiber and Dyed with Conventional Reactive Dyeing Procedure, Fabric Made with Exhaust Pretreated Fiber and Dyed Using "No Chemical" Dye Procedure, Fabric Made with Saturate/Store Pretreated Fiber and Dyed Using "No Chemical" Dye Procedure, and Fabric Made with Saturate/Store Pretreated Fiber and Dyed Using "No Chemical" Dye Procedure and 25% Reduction of Dye, and Fabric Made with Saturate/Store Pretreated Fiber and Dyed Using "No Chemical" Dye Procedure and 50% Reduction of Dye.

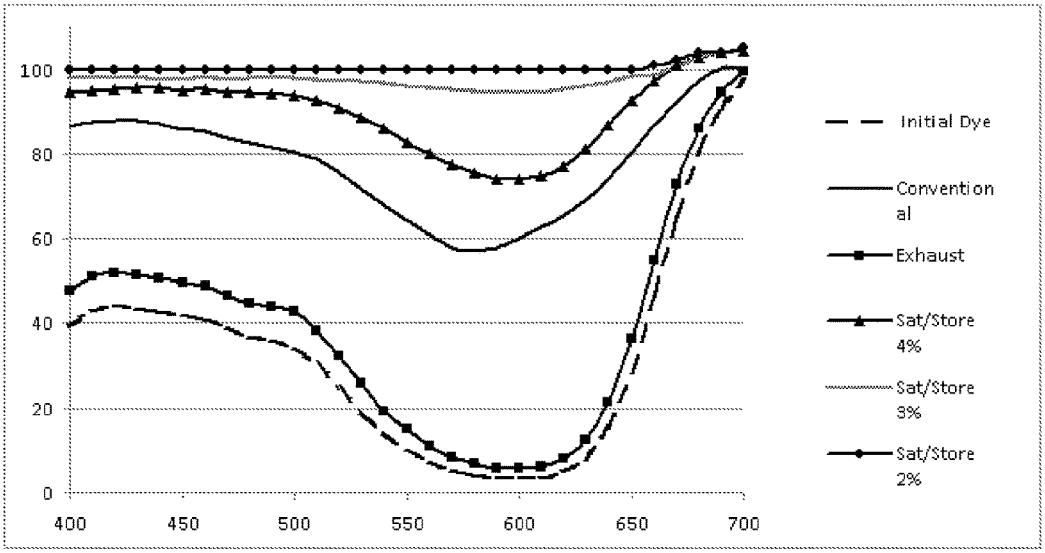

Fig. 19 – Graphic Representation of the Initial Dye Bath Concentration and the Residual Dye Bath of Fabric made with Untreated Cotton Fiber and Dyed with Conventional Reactive Dyeing Procedure, Fabric Made with Exhaust Pretreated Fiber and Dyed Using "No Chemical" Dye Procedure, Fabric Made with Saturate/Store Pretreated Fiber and Dyed Using "No Chemical" Dye Procedure, Fabric Made with Saturate/Store Pretreated Fiber and Dyed Using "No Chemical" Dye Procedure and 25% Reduction of Dye, and Fabric Made with Saturate/Store Pretreated Fiber and Dyed Using "No Chemical" Dye Procedure and 50% Reduction of Dye.

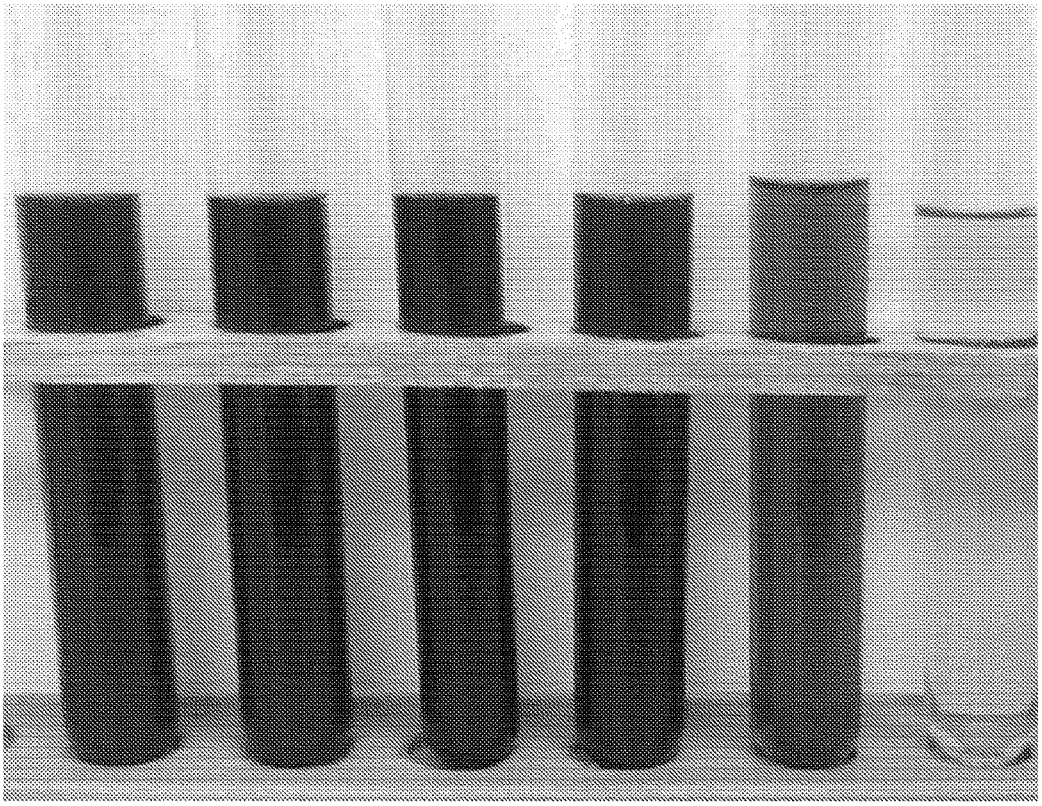

Fig. 20 – Left to Right-(1) Initial Dye Concentration 4% Everzol Navy ED. Residual Dye Baths of (2) Fabric made with Untreated Cotton Fiber and Dyed with Conventional Reactive Dyeing Procedure, (3) Fabric Made with Exhaust Pretreated Fiber and Dyed Using "No Chemical" Dye Procedure, (4) Fabric Made with Saturate/Store Pretreated Fiber and Dyed Using "No Chemical" Dye Procedure- 4% Navy ED , (5) Fabric Made with Saturate/Store Pretreated Fiber and Dyed Using "No Chemical" Dye Procedure and 25% Reduction of Dye- 3% Navy ED, and (6) Fabric Made with Saturate/Store Pretreated Fiber and Dyed Using "No Chemical" Dye Procedure and 50% Reduction of Dye- 2% Navy ED.

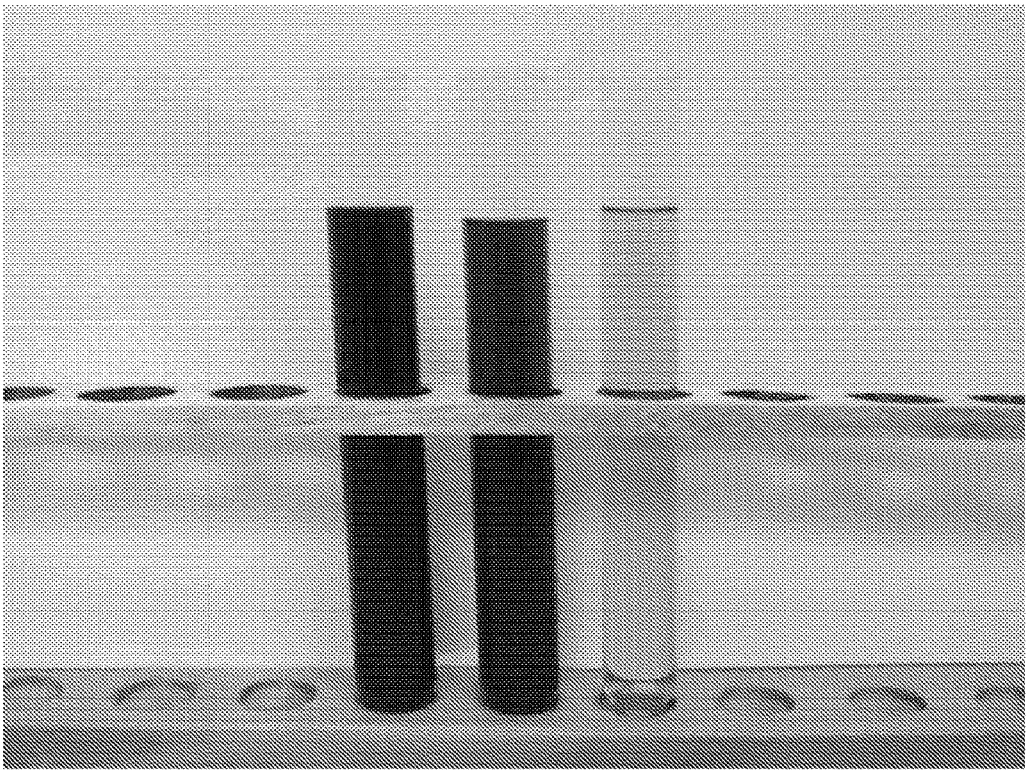
Fig. 21 - Comparisons of dye baths of saturate/store pretreated cotton fabrics dyed with a "no chemical" dye procedure. Left to right - 4% Everzol Navy ED, 3% Everzol Navy ED, and 2% Everzol Navy ED.

TREATMENT OF FIBERS FOR IMPROVED DYEABILITY

This technology relates to the field of textiles, in particular the process of imparting colors and hues to fibers through the use of dyestuffs, and to methods of improving the efficiency of such processes.

BACKGROUND

Textiles are often dyed as part of the process of manufacturing clothing, furnishings and other consumer items that include textiles. However, the process of treating textiles with dyestuffs is often expensive, inefficient and environmentally unsound. For example, traditional cellulose dyeing processes require the use of large amounts of water, salt, alkali, and heat and can generate excessive pollution. In addition, the inefficiency of traditional textile dyeing results in poor ability to achieve a desired color, as well as problems such as bleeding and fading. These problems can lead to the need for large amounts of water, energy, dye, and chemicals to achieve desired colors, and therefore higher costs and greater environmental impact during the dyeing processes. The inefficiency of dyeing can further lead to undesirable bleeding or fading of colors before or after purchase and use by customers, resulting in poor quality control of dyed textiles.

SUMMARY OF THE TECHNOLOGY

In certain embodiments, the present technology is directed to a method of treating a cellulose fiber. The method comprises obtaining a fiber; and contacting it with a solution comprising about 0.5 to about 15 g/L of a wetting agent; about 5 to about 300 g/L of an alkaline composition; and about 5 to about 200 g/L of an ammonium salt. The technology provides for the solution to react. The fiber can be removed from contact with the solution; and extracted to a moisture content between 75% and 150%. The fiber can be stored in a closed container for a period of time, for example, about 8 to about 24 hours.

In other embodiments, the present technology is directed to a method of minimizing the amount of dye required to dye a fiber to a desired color. This method comprises treating the fiber by contacting it with a solution comprising a wetting agent, an alkaline composition and an ammonium salt. The fiber can be removed from contact with the solution and extracted to a moisture content between 75% and 150%. The fiber can be stored in a closed container for a period of time, for example, about 8 to about 24 hours. The fiber can also be removed from the closed container and neutralized, for example by rinsing in an acid solution. The fiber can then be dried and can be contacted with a dye until the fiber reaches a desired color.

This technology provides for dyeing fiber using less water, energy dye, chemicals and time. For example, the result may be up to 90% less water, 75% less energy, 50% less dye, 95% less chemicals, and one third the time compared to untreated fiber.

In other embodiments, the present technology is directed to a method of optimizing the retention of a dye in a fiber, comprising treating the fiber by contacting it with a solution comprising a wetting agent, an alkaline composition and an ammonium salt, including but not limited to a quaternary ammonium salt. The fiber can be removed from contact with the solution and extracted to a moisture content between 75% and 150%. The fiber can be stored in a closed container for a period of time, for example, about 8 to about 24 hours. The fiber can also be removed from the closed container and neutralized, for example by rinsing in an acid solution. The fiber can then be dried and can be contacted with a dye until the fiber reaches a desired color.

In other embodiments, the present technology is directed to a fabric comprising a fiber that has been pretreated with a solution comprising a wetting agent, an alkaline composition and an ammonium salt. The pretreatment step can include storage of the fiber in a closed container for a period of about 8 to about 24 hours.

In other embodiments, the present technology is directed to a method of dyeing a fabric, comprising treating a fiber by contacting the fiber with a solution comprising a wetting agent, caustic soda and an ammonium salt. The fiber can be processed into a yarn and knitter or woven to produce fabric. The fabric can be contacted with a dye to bring the fabric to a desired color such that the amount of dye required to bring the fabric to the desired color is at least about 25% less than the amount of dye required to dye a sample of the same fabric untreated.

BRIEF DESCRIPTION OF THE DRAWINGS

FIG. 1 shows the results of a comparative test demonstrating a desired color of fabric dyed in accordance with a method of the present technology. It compares reflectance values of: (1) fabric made with untreated cotton fiber and dyed with conventional reactive dyeing procedure; (2) fabric made with exhaust pretreated fiber and dyed using "no chemical" dye procedure; (3) fabric made with inventive saturate/store pretreated fiber and dyed using "no chemical" dye procedure; and (4) fabric made with inventive saturate/store pretreated fiber and dyed using "no chemical dye procedure" with 25% reduction of dye and 50% reduction of dye.

FIG. 3 shows transmittance values for conventional reactive dye bath and sequential rinse baths of fabric made with untreated cotton fiber and dyed with a conventional reactive dyeing procedure.

FIG. 4 shows a graphic representation of the reduction of color from conventional dye bath and each sequential rinse of fabric made with untreated cotton fiber and dyed with a conventional reactive dyeing procedure.

FIG. 5 shows samples of dye bath and sequential rinse baths of untreated cotton fabric dyed with a conventional reactive dye procedure (4% Everzol Navy ED).

FIG. 6 shows transmittance values for exhaust pretreatment dye bath and sequential rinse baths of fabric made with exhaust pretreated fiber and dyed using a "no chemical" dye procedure.

FIG. 7 shows a graphic representation of the reduction of color from dye bath and each sequential rinse of fabric made with exhaust pretreated fiber and dyed using a "no chemical" dye procedure.

FIG. 8 shows samples of dye bath and sequential rinse baths of exhausted pretreated cotton fabric dyed with a "no chemical" dye procedure (4% Everzol Navy ED).

FIG. 9 shows transmittance values for dye bath and sequential rinse baths of fabric made with an inventive saturate/store pretreated fiber and dyed using a "no chemical" dye procedure.

FIG. 10 shows a graphic representation of the reduction of color from dye bath and each sequential rinse of fabric made with an inventive saturate/store pretreated fiber and dyed using a "no chemical" dye procedure.

FIG. 11 shows samples of dye bath and sequential rinse baths of saturate/store pretreated cotton fabric dyed with a "no chemical" dye procedure (4% Everzol Navy ED).

FIG. 12 shows transmittance values for dye bath and sequential rinse baths of fabric made with saturated/stored pretreated fiber and dyed using a "no chemical" dye procedure and 25% reduction of dye (3% Everzol Navy ED).

FIG. 13 shows a graphic representation of the reduction of color from the dye bath and each sequential rinse of fabric made with saturated/stored pretreated fiber and dyed using a "no chemical" dye procedure and 25% reduction of dye (3% Everzol Navy ED).

FIG. 14 shows samples of dye bath and sequential rinse baths of saturated/stored pretreated cotton fabric dyed with a "no chemical" dye procedure and 25% reduction of dye (3% Everzol Navy ED).

FIG. 15 shows transmittance values for dye bath and sequential rinse baths of fabric made with saturated/stored pretreated fiber and dyed using a "no chemical" dye procedure and 50% reduction of dye (2% Everzol Navy ED).

FIG. 16 shows a graphic representation of the reduction of color from the dye bath and each sequential rinse of fabric made with saturated/stored pretreated fiber and dyed using a "no chemical" dye procedure and 50% reduction of dye (2% Everzol Navy ED).

FIG. 17 shows a sample of the dye bath of saturated/stored pretreated cotton fabric dyed with a "no chemical" dye procedure and 50% reduction of dye (2% Everzol Navy ED).

FIG. 18 shows transmittance values for the initial dye concentration and the residual dye bath of: 1) fabric made with untreated cotton fiber and dyed with conventional reactive dyeing procedure; (2) fabric made with exhaust pretreated fiber and dyed using "no chemical" dye procedure; (3) fabric made with saturate/store pretreated fiber and dyed using "no chemical" dye procedure with 4% Everzol Navy ED; (4) fabric made with saturate/store pretreated fiber and dyed using "no chemical dye procedure" with 25% reduction of dye and 50% reduction of dye; and (5) fabric made with saturate/store pretreated fiber and dyed using "no chemical dye procedure" with 50% reduction of dye.

FIG. 19 shows a graphical representation of the initial dye bath concentration and the residual dye bath of: 1) fabric made with untreated cotton fiber and dyed with conventional reactive dyeing procedure; (2) fabric made with exhaust pretreated fiber and dyed using "no chemical" dye procedure with 4% Everzol Navy ED; (3) fabric made with saturate/store pretreated fiber and dyed using "no chemical" dye procedure with 4% Everzol Navy ED; (4) fabric made with saturate/store pretreated fiber and dyed using "no chemical dye procedure" with 25% reduction of dye and 50% reduction of dye; and (5) fabric made with saturate/store pretreated fiber and dyed using "no chemical dye procedure" with 50% reduction of dye.

FIG. 20 shows comparisons of initial dye concentration and the residual dye bath of: 1) fabric made with untreated cotton fiber and dyed with conventional reactive dyeing procedure; (2) fabric made with exhaust pretreated fiber and dyed using "no chemical" dye procedure with 4% Everzol Navy ED; (3) fabric made with saturate/store pretreated fiber and dyed using "no chemical" dye procedure with 4% Everzol Navy ED; (4) fabric made with saturate/store pretreated fiber and dyed using "no chemical dye procedure" with 25% reduction of dye and (5) fabric made with saturate/store pretreated fiber and dyed using "no chemical dye procedure" with 50% reduction of dye.

FIG. 21 shows comparisons of dye baths of saturate/store pretreated cotton fabrics dyed with a "no chemical" dye procedure (4% Everzol Navy ED, 3% Everzol Navy ED and 2% Everzol Navy ED).

DETAILED DESCRIPTION

Figure 2:
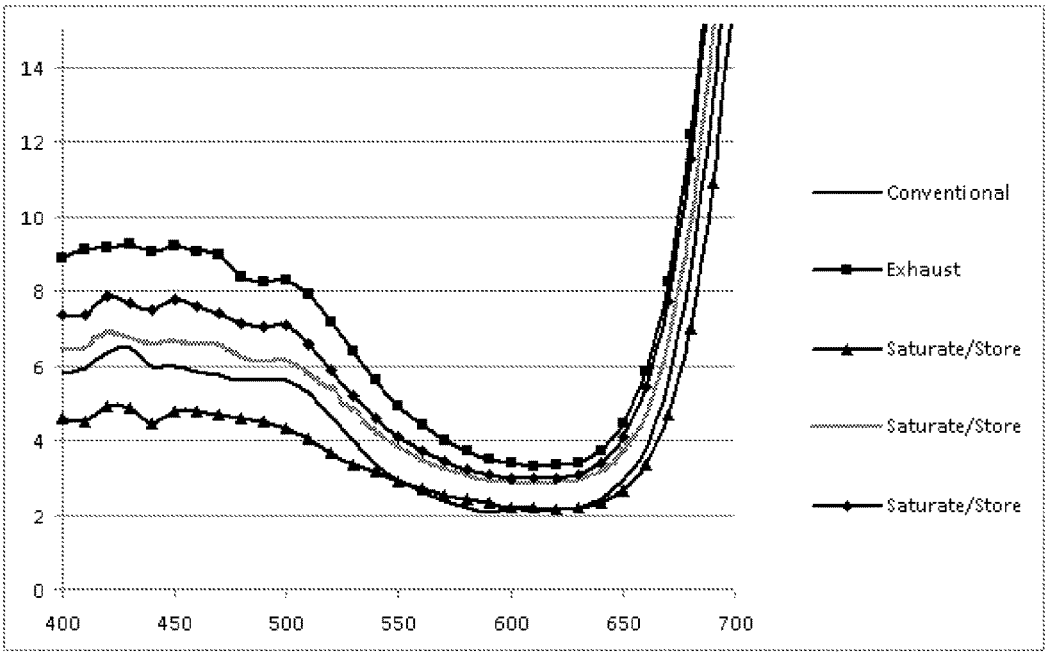
FIG. 2 shows the results of a comparative test demonstrating a desired color of fabric dyed in accordance with a method of the present technology. It compares the level of dye exhaustion of (as listed from top to bottom in the legend on the right side of the Figure): 1) fabric made with untreated cotton fiber and dyed with conventional reactive dyeing procedure; (2) fabric made with exhaust pretreated fiber and dyed using "no chemical" dye procedure with 4% Everzol Navy ED; (3) fabric made with saturate/store pretreated fiber and dyed using "no chemical" dye procedure with 2% Everzol Navy ED (50% reduction of dye); (4) fabric made with saturate/store pretreated fiber and dyed using "no chemical dye procedure with 3% Everzol Navy ED (25% reduction of dye); and (5) fabric made with saturate/store pretreated fiber and dyed using "no chemical dye procedure with 4% Everzol Navy ED.

Throughout the disclosure of the present technology, the disclosures of all references cited are hereby incorporated by reference in their entireties. In the case of any conflicts in definitions between the disclosures of such references and the present disclosure, the present disclosure controls.

As used herein, the term "fiber" refers to a delicate, hair portion of the tissues of a plant or animal or other substance that is very small in diameter in relation to its length.

As used herein, the term "continuous grouping of fibers" refers to a continuous bundle of loosely assembled untwisted fibers.

As used herein, the term "yarn" means a continuous strand of textile fibers created when a cluster of individual fibers are twisted together.

As used herein, the term "fabric" means the final, finished textile material that results from the knitting or weaving of yarns produced from fibers and can ultimately be cut and sewn into clothing, furnishings or final item.

As used herein, the term "wet pickup" means the amount of solution retained by the fiber after complete saturation and extraction, and is calculated by the ratio of the wet weight of the fiber to its dry weight.

In certain embodiments, the present technology is directed to processes for the chemical application and modification of a fiber, for example a cellulosic fiber such as cotton fiber, to improve the receptivity and efficiency of dyeing with dyes.

In certain embodiments, a process in accordance with the technology herein will exhibit one or more of the following equations:

(I)

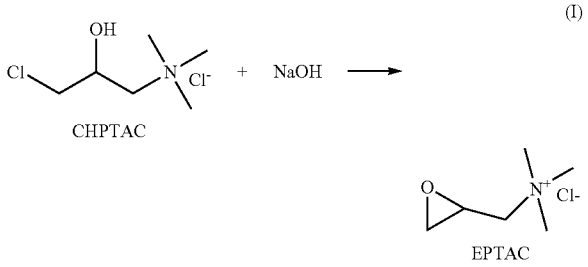

-continued (II)

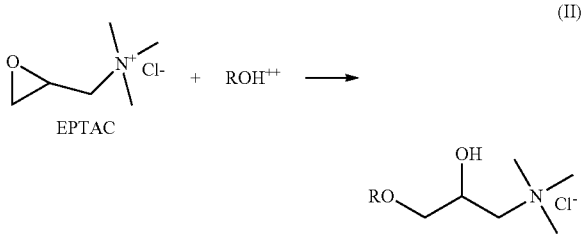

Equation I demonstrates the reaction of 3-Chloro-2-hydroxypropyltrimethylammonium chloride (CHPTAC), a particular quaternary ammonium salt, with an alkaline composition (in this case, caustic soda, NaOH) to produce epoxypropyltrimethylammoniumchloride (EPTAC), which is the epoxide of the CHPTAC. CHPTAC is not reactive with cellulose; therefore, it must first be converted into the reactive epoxide form of EPTAC before reaction with the cellulose.

Equation II demonstrates the reaction of the EPTAC with the cellulose molecule ($ROH^{++}$) to produce "positively charged cotton." The reaction creates a permanent positive charged site on the cellulose molecule which can attract an anionic (negative charged) compound such as an anionic dyestuff. This is the pretreated cotton, which can then be contacted with the dyestuff.

Dyes

The embodiments of the technology herein contemplate the application of dyes to fiber that is desired to be dyed. In certain embodiments, anionic dyes (for example, reactive dyes, direct dyes and acid dyes) are found to be useful for the applications herein. In other embodiments, the dye used need not be anionic but may still be useful for the methods herein. For example, vat dyes and sulfur dyes are dyes that are found to be useful for certain embodiments herein. Any dye that exhibits an affinity for the fibers contemplated herein may be appropriate. For example, in embodiments wherein the fibers are cotton fibers, any dye that exhibits an affinity for cellulose may be useful for the present embodiments.

Fiber

Fibers useful for the embodiments herein include, but are not limited to, cellulosic fibers such as cotton fiber (either as separate fibers or in the form of a continuous grouping of fibers or yarn), linen, viscose, bamboo, jute, hemp, flax and any other cellulosic fiber. After pretreating the fiber it can be dyed, or the fiber can be spun into yarn which could be dyed, or the yarn could be knitted or woven into fabric which could be dyed, or the fabric could be made into a finished product, for example a garment, which could be dyed. The fiber may be pretreated in its free form, or in the form of a continuous grouping of fibers.

Pretreatment Solution

In various embodiments, the methods herein comprise contacting a fiber with a pretreatment solution before contacting the fiber with the dye. The pretreatment solution can advantageously impact the fiber in a manner that enables it to exhibit superior properties when subsequently contacted with the dye, such as, for example, an increased ability to retain the dyestuff such that a lower amount of dyeing solution is required to achieve a desired hue; superior ability of the final fabric to retain the dye without fading over time and after multiple washings; and lessened environmental impact, water use or energy use.

The pretreatment solution comprises, in certain embodiments, a wetting agent; an alkaline composition such as alkali hydroxide or alkali metal hydroxide e.g., sodium hydroxide (caustic soda) or potassium hydroxide (potash caustic), and a salt, such as an ammonium salt (for example, a quaternary ammonium salt), as well as any other alkali hydroxide, including lithium hydroxide, rubidium hydroxide or cesium hydroxide.

The wetting agent may comprise, in certain embodiments, a blend of anionic and nonionic surfactants, for example one that is commercially available under the trade name "Cottoclarin 88 ECO" from Pulcra Specialty Chemicals, Ltd. of Shanghai, China. Such composition has been found to be useful for generating instantaneous wetting and penetration of the fiber. Such compositions are particularly known to be useful for cotton fiber.

In certain embodiments, the fiber may be contacted with the pretreatment solution in any of numerous ways; for example, it has been discovered that desirable results can be achieved when the pretreatment solution is applied in a padding process. The fiber can, for example, be saturated in a trough and passed through rollers or padders. The fiber can be contacted with the pad for a period of time, for example, about 15 to about 30 seconds. Spray or foam applicators can also be used—that is, the pretreatment solution may be applied to the fiber by spraying or foaming directly onto the fiber.

In certain embodiments, the pretreatment solution includes a composition comprising an amino group—for example, an ammonium salt. Examples of useful ammonium salts for the embodiments of the present technology include, e.g, quaternary ammonium salts. An exemplary quaternary ammonium salt is 3-Chloro-2-hydroxypropyltrimethylammonium chloride (CHPTAC, also known as PTAC) and which is available under the trade name "Catdye" from MFI Technologies, Inc. of Mooresville, N.C., USA.

In certain embodiments, the pretreatment solution includes an alkaline composition. Examples of useful alkaline compositions include, but are not limited to, sodium hydroxide (caustic soda), potassium hydroxide and the like, as well as blends of any of the foregoing.

Closed Container

In certain embodiments, the methods and processes of the present technology further comprise the step of storing the fiber in a film or closed container, after the contact of the fiber with the pretreatment solution. As used herein, "closed container" means a film, container or vessel that is substantially separate from contact with the outside environment. In various embodiments, the film can be a plastic film and the closed container can be a vessel or tank with a lid or any other holding container in which the sample of fiber may be stored to substantially prevent exposure to the ambient air and environment and to substantially prevent the introduction of impurities or removal of any portion of the samples of fiber or the solution in which they are stored In various embodiments, the fiber is stored in the closed container for a period of time of about 8 to about 24 hours, about 12 to about 20 hours, or about 15 to about 18 hours. In certain embodiments, the closed container may be heated; however, an advantage of this process step is that desirable results can be achieved without the addition of heat—that is, the reactions can take place at room temperature.

Acid

In certain embodiments, after the fiber has been stored for the required period of time in the closed container, it is taken out of the storage unit and then contacted with an acid solution. This contact will have the effect of bringing the pH of the fabric down to an acidic level after exposure to the alkaline composition. This is particularly useful because known methods for dyeing fabrics often result in high amounts of alkaline effluent; thus, adding acid to the effluent of any pretreatment step can neutralize the solutions and minimize their environmental impact.

In various embodiments, the fiber may be contacted with a continuous stream of an acid solution. In the embodiments herein, any acid solution that is effective in lowering the pH of the liquid present in the fiber may be useful for the purposes discussed herein. It has been found that organic acids such as citric acid are particularly useful; however, other acids such as, e.g., acetic acid or phosphoric acid may also be used. As used herein, "the pH of the fabric" refers to the pH of the retained liquid in the fabric; this is measured by collecting the liquid that flows out of the fabric (by collecting it as it drips, or optionally by applying mechanical pressure to the fabric, e.g., by squeezing, rolling or the like) and then measuring the pH of the liquid that flows out of the fabric. In various embodiments, the amount of acid used is sufficient to maintain the pH of the fabric under about 7.0, under about 6.5, under about 6.0, under about 5.0, under about 4.8, about 4 to about 6.5 or about 4 to about 5.

After completion of the methods of the various embodiments discussed herein, the continuous grouping of fibers may be processed into loose fibers, or may be kept in their state as a continuous grouping of fibers, or may be processed into yarns, or may be woven or knitted into fabric. It has been found that pretreatment of fiber in accordance with the embodiments of the present technology impart many advantages to the fiber.

In certain embodiments, the fibers may then undergo a dyeing process after the pretreatment processes as described herein. In other embodiments, they may be processed into yarn and then dyed; or woven or knitted into fabric and then dyed, or turned into the final consumer product and then dyed. Regardless of which stage the dyeing is performed, it has been found that the advantages due to the pretreatment remain in the fibers.

Various embodiments of the technology will be more fully described herein in the Examples.

EXAMPLE 1

Pretreatment Process—Inventive "Saturate/Store" Process

Baled cotton fiber is processed to produce a card lap or into a continuous grouping of fibers. The fiber is taken to an application machine where the fiber travels into a pad trough and comes into contact with a solution that contains:

1. about 1 to about 10 g/L Cottoclarin 88 ECO wetting agent;
2. about 10 to about 100 g/L caustic soda (NaOH);
3. about 10 to about 150 g/L "Catdye" CPHTAC;

The fiber is saturated in the pad trough and is extracted so that it retains a wet pickup of about 65 to about 150% of the pad solution. After extraction, the resulting fiber is sealed in storage containers. The containers are stored for about 8 to about 24 hours at room temperature, during which time the reaction between the solution and the fiber occurs.

After the storage time is complete, the fiber is removed from the containers and rinsed with an acid solution to lower the pH of the fiber to a range of about 4 to about 6.5. The fiber can then be extracted to a moisture content of below about 40% and dried in a heated oven. The dry fiber can be baled as loose fiber.

EXAMPLE 2 (COMPARATIVE EXAMPLE)

Pretreatment Process—"Exhaust" Process

The fiber is placed into stainless steel perforated carriers and placed into sealed vessels that can circulate a treating solution through the fiber. The solution contains:

1. about 3 to about 15 g/L wetting agent;
2. about 25 to about 100 g/L caustic soda (NaOH);
3. about 25 to about 150 g/L "Catdye" CPHTAC;

The amount of water contained in these vessels is about 5 to about 10 times the amount required for Example 1. The solution is heated to about 60 to about 90 degrees C. The solution is allowed to circulate for about 30 to about 90 minutes at that temperature. The solution is then drained and the fiber is washed with water at about 60 to about 80 degrees C. This rinse bath is drained and the vessel is now filled with colder water and enough acid to reduce the pH to below about 6.5. The fiber carriers are then taken from the vessels and the excess water is removed from the fiber. The fiber is then removed from the carrier, dried, and baled as loose fiber.

EXAMPLE 3 (COMPARATIVE EXAMPLE)

4% Dye Solution with a Conventional Reactive Dye Procedure (No Pretreatment)

A 20 gram sample of conventional, untreated cotton knit fabric was dyed as follows: the sample was prepared in an aqueous bath having a water volume of 10:1 containing 1 g/L of Amwet AFX (a nonionic wetting agent). The solution and fabric were heated to 80 degrees C. and circulated for 15 minutes to ensure complete wetting. This solution was drained.

A fresh aqueous bath having a water volume of 10:1 was prepared at 35 degrees C. with 4% Enverzol Navy ED (owg) (available from Everlight Chemicals USA) and added to the fabric. The fabric was agitated for 5 minutes and 80 g/L of $NaSO_4$ (sodium sulfate) was dissolved in the bath. 20 g/L of $NaCO_3$ (soda ash) was added to the dye bath. The dye bath was heated to 60 degrees C. and agitated for 45 minutes. The dye bath was drained and retained.

200 mL of fresh water was added to the fabric and agitated at 35 degrees C. for 10 minutes. This bath was drained and noted as 1st rinse.

200 mL of fresh water with 1 g/L citric acid was added to the fabric, and agitated at 70 degrees C. for 10 minutes. This bath was drained and noted as 2nd rinse.

200 mL of fresh water with 2 g/L soaping agent was added to the fabric, and agitated at 95 degrees C. for 10 minutes. This bath was drained and noted as 3rd rinse.

200 mL of fresh water was added to the fabric, and agitated at 60 degrees C. for 10 minutes. This bath was drained and noted as 4th rinse.

Four additional rinses were continued at 35 degrees C., each for 10 minutes until the bath was clear.

The amount of dye rinsed out, as well as the number of rinses required to obtain a clear bath, was noted and recorded as follows: the residual dye bath (amount of dye left after the dyeing was completed) and all rinse baths were evaluated using a spectrophotometer to determine transmittance values. Theses values provided indication of the amount of dye remaining in the fabric after each step and are listed in FIG. 3. FIG. 4 is a graphical representation of the reduction of color with each step. As can be observed in FIG. 4, it requires numerous rinses to remove the unfix dye from untreated cotton using the conventional reactive dye procedure. The conventional procedure also requires high temperature washes to improve the unfixed dye removal. Significant color reduction is not accomplished until after these hot washes. This can be noted in FIG. 4 as the line graph moves toward 100. The reduction in color with each step can visually be noted in FIG. 5.

EXAMPLE 4 (COMPARATIVE EXAMPLE)

"No Chemical" Dyeing (4% Dye Solution) with Reactive Dye Using Pretreated Cotton ("Exhaust" Pretreatment Method)

A 20 gram sample of a cotton knit fabric made with yarn produced from fiber that was exhaust pretreated with a wetting agent (in accordance with a known pretreatment method) was obtained. The fabric was treated with a "no chemical" dye procedure as follows: the sample was added to an aqueous bath having a water volume of 10:1 containing 1 g/L of Amwet AFX (a nonionic wetting agent). The fabric was agitated for 5 minutes. To this aqueous bath that was prepared at 35 degrees C., 4% Enverzol Navy ED (owg) was added. The fabric was agitated in this dye bath while maintaining the temperature at 35 degrees C. for 30 minutes. The dye bath temperature was then increased to 80 degrees C. This temperature was maintained for an additional 15 minutes. After this time, the dyeing was completed and the dye bath was drained and retained.

200 mL of fresh water was added to the fabric, and agitated at 35 degrees C. for 10 minutes. This bath was drained and noted as 1st rinse.

200 mL of fresh water was added, and agitated at 70 degrees C. for 10 minutes. This bath was drained and noted as 2nd rinse.

Five additional rinses were continued at 35 degrees C., each for 10 minutes until the bath was clear.

It was observed that the fabric dyed using the exhaust pretreated fiber did not develop the same depth of color as the fabric dyed using the conventional reactive procedure (as used herein, "conventional reactive procedure" means dyeing of untreated fabric using chemicals (that is, not a "no chemical" dyeing procedure as described herein). This can be determined when comparing the reflectance information in FIG. 1 and FIG. 2. The dyeing of the same percentage of Everzol Navy ED produces a shade considerably less. With the exhaust treated fabric in produced in Example 2, color can be obtained without the need of chemicals but not to the level of the conventional procedure shade in Example 3 with its required chemicals. This lower yield of color resulted in more residual dye left in the dye bath and requires numerous washes to try and remove. FIG. 6 and FIG. 7 confirm the color removal during washing. The lower yield and numerous washing were due to the low efficiency of the reaction of the exhaust ammonium salt application to the fiber. FIG. 8 shows the color reduction during the rinses and confirms that one less rinse is required and is accomplished with lower temperature. The dye was removed from the fabric easier and without the need of high temperature, but because of the higher residual dye it required numerous rinses.

EXAMPLE 5

"No Chemical" Dyeing (4% Dyeing Solution) with Reactive Dye Using Inventive Pretreated Cotton Procedure Cotton knit fabric was made from yarn that was pretreated in accordance with an embodiment of the present technology (also referred to herein as the "saturate/store" technology). A 20 gram sample of the cotton knit fabric was added to an aqueous bath having a water volume of 10:1 containing 1 g/L of Amwet AFX (a nonionic wetting agent). The fabric was agitated for 5 minutes. To this aqueous bath that was prepared at 35 degrees C. was added 4% Enverzol Navy ED (owg). The fabric was agitated in this dye bath while maintaining the temperature at 35 degrees C. for 30 minutes. The dye bath temperature was then increased to 80 degrees C. This temperature was maintained for an additional 15 minutes. The dye bath was drained and retained.

200 mL of water was added to the fabric, and agitated at 35 degrees C. for 10 minutes. This bath was drained and noted as 1st rinse.

200 mL of fresh water was added and agitated at 35 degrees C. for 10 minutes. This bath was drained and noted as 2nd rinse.

One additional rinse was continued at 35 degrees C., for 10 minutes until the bath was clear.

It was observed that the fabric made from fiber pretreated with the inventive saturate/store application has a shade that was darker than the results of Example 3 and Example 4. This indicates that more color was exhausted for the dye bath than the conventional reactive procedure and the exhaust fiber application (i.e., more dye made it onto the fabric, and less dye was wasted). This was confirmed in comparing reflectance values in FIG. 1 and FIG. 2. With more color exhausting onto the fabric, there is less residual dye left in the dye bath and less unfixed dye on the dyed fabric to be rinsed out. FIG. 9 and FIG. 10 confirm the lower dye bath level and that the necessity of only three rinses to produce a clear rinse bath. FIG. 11 confirms the need for only 3 rinses.

As can be seen, fewer rinses and higher dye exhaustion generates a significant water and time savings when compared to conventional reactive dyeing. This pretreated fabric using the "no chemical" dyeing produced a dark navy color equal or better than a conventional reactive procedure without the need of dyeing chemicals (salt and alkali) that are required to dye untreated cotton. Using fabric produced with the inventive saturate/store application cotton fiber, the required dye chemicals that cause pollution when discharged into the environment can now be eliminated. The shorter dye cycle (fewer rinses) and lower temperature requirement due to the high efficiency of pretreatment all contribute to significant energy savings for dyeing.

EXAMPLE 6

"No Chemical" Dyeing (3% Dyeing Solution) Using Inventive Pretreated Cotton Procedure A 20 gram sample was obtained of a cotton fabric that was made with yarn produced from fiber pretreated in accordance with an embodiment of the inventive saturate/store technology described herein. This fabric was dyed using the "no chemical" dye procedure as follows: The fabric was added to an aqueous bath having a water volume of 10:1 containing 1 g/L of Amwet AFX (a nonionic wetting agent). The fabric was agitated for 5 minutes. To this aqueous bath that was prepared at 35 degrees C., 3% Enverzol Navy ED (owg) was added. The fabric was agitated in this dye bath while maintaining the temperature at 35 degrees C. for 30 minutes. The dye bath temperature was then increased to 80 degrees C. This temperature and agitation was maintained for an additional 15 minutes. After this time, the dyeing was completed and the dye bath was drained and retained.

200 mL of fresh water was added to the fabric, and agitated for 10 minutes at 35 degrees C. This bath was drained and noted as 1st rinse.

200 mL of fresh water was added and agitated at 35 degrees C. for 10 minutes. This bath was drained and noted as 2nd rinse. No additional rinses were needed because the resulting rinse bath was clear.

Since a darker shade was obtained with the dyeing in Example 5 than Example 3 (Comparative Example), it was concluded, as can be seen from FIG. 11, that there was still some unfixed dye in the dye bath. For this reason, this Example 6 was prepared using the sample fabric and "no chemical" procedure as used in Example 5 and only reducing the Everzol Navy ED from 4% to 3% (owg). This is a 25% reduction in color from Example 3 to Example 5. The result of this dyeing was observed, as shown in FIG. 12 and FIG. 13. FIG. 2 provides a graphic representation of the differences of each dyeing (conventional, exhaust pretreatment, inventive saturate/store pretreatment with 4% dye solution, inventive saturate/store pretreatment with 3% dye solution, and inventive saturate/store pretreatment with 2% dye solution.

As can be seen in FIG. 13, results confirmed that the reduced level of dye resulted in more dye being exhausted form the dye bath and out of solution. Only two rinses were required to remove the color from the fabric. This was observed as shown in FIG. 14.

EXAMPLE 7

"No Chemical" Dyeing (2% Dyeing Solution) Using Inventive Pretreated Cotton Procedure A 20 gram sample was obtained of a cotton fabric that was made with yarn produced from fiber pretreated in accordance with an embodiment of the inventive "saturate/store" technology. This fabric was dyed using the "no chemical" dye procedure as follows: the fabric was added to an aqueous bath having a water volume of 10:1 containing 1 g/L of Amwet AFX (a nonionic wetting agent). The fabric was agitated for 5 minutes. To this aqueous bath that was prepared at 35 degrees C., 2% Enverzol Navy ED (owg) was added. The fabric was agitated in this dye bath while maintaining the temperature at 35 degrees C. for 30 minutes. The dye bath temperature was then increased to 80 degrees C. This temperature and agitation was maintained for an additional 15 minutes. After this time, the dyeing was completed and the dye bath was drained and retained. No additional rinses were required because the resulting dye bath was clear.

In order to determine if the dye bath could be completely cleared, this Example was prepared using cotton fabric that was made with yarn produced from fiber pretreated in accordance with an embodiment of the inventive saturate/store technology. This sample was dyed with the 2% Everzol Navy ED, representing a 50% reduction in dye from Example 1 and Example 3. FIG. 15 and FIG. 16 show the color remaining after dyeing. The dye was completely exhausted. This confirms that the embodiments herein are vastly superior to methods known in the art, in that they will allow for dyestuff to be removed from the dye bath and permit recycling of the water used in dyeing. FIG. 17 is a visual observation of this dye bath. As can be seen, the dye bath is visually clear, showing the optimal result desired.

FIG. 18 and FIG. 19 show a comparison of all parameters from among all of the dye baths used herein—that is, Example 3, Example 4, Example 5, Example 6, Example 7 and a bath containing the initial concentration of 4% Everzol Navy ED. Using the conventional reactive dyeing procedure on untreated cotton (Example 3) as the standard, the following difference in time, water, chemicals, and dye can be calculated:

With Example 4, there is a 99% savings on chemicals required. The amount of dye is the same though the depth color obtained is less. Since one less rinse was required to clear the bath, this represents only an 11% savings in water and a 24% time reduction.

Example 5 has the same 99% savings on chemicals but used the same level of dye and achieved a darker shade than Example 4. Only 3 rinses were required to clear the bath, representing a 56% savings in water and a 46% reduction in time.

Example 6 still represents a 99% chemical savings and adds a 25% dyestuff savings. Two rinses were required, generating a 67% water savings and resulting in a 56% time savings.

Example 7 demonstrates 50% dye reduction with the continuing 99% chemical savings. Because all the dye is exhausted during the dye cycle, there is a 90% savings of water and the savings in time is 62%.

It should be noted that the Examples above are merely illustrative, not limiting to the present technology, and that additional embodiments and variations are possible without departing from the spirit of the technology.

What is claimed is:

1. A method of treating a cellulose fiber, the method comprising the steps of:

(a) obtaining a sample of the fiber;

(b) contacting the sample of the fiber with a solution, the solution comprising:

i. about 0.5 to about 15 g/L of a wetting agent;

ii. about 5 to about 150 g/L of an alkaline composition; and iii. about 5 to about 200 g/L of an ammonium salt; and (c) providing for the solution to react with the fiber.

2. The method of claim 1, wherein the wetting agent comprises a nonionic surfactant.

3. The method of claim 1, wherein the wetting agent comprises an anionic/nonionic blended surfactant.

4. The method of claim 1, wherein the alkaline composition comprises sodium hydroxide or potassium hydroxide.

5. The method of claim 1, wherein the ammonium salt comprises 3-chloro-2-hydroxypropyltrimethylammonium chloride (CHPTAC).

6. The method of claim 1, wherein step (b) comprises immersing the sample of the fiber in the solution.

7. The method of claim 6, wherein step (b) comprises immersing the sample of the fiber in the solution for a period of about 10 to about 60 seconds.

8. The method of claim 1, wherein step (b) comprises contacting the sample of the fiber with a saturation pad that contains the solution.

9. The method of claim 1, wherein step (c) comprises removing the sample of the fiber from the solution and storing the sample of the fiber in a closed container for a period of about 8 to 24 hours.

10. The method of claim 1, further comprising the step of:

(d) contacting the fiber with an acid in an amount sufficient to maintain a pH of less than about 6.0 on the surface of the fiber.

11. A method of minimizing the amount of dye required to dye a fiber to a desired color, the method comprising the steps of:

(a) treating the fiber by contacting it with a solution comprising a wetting agent, an alkaline composition and an ammonium salt;

(b) removing the fiber from contact with the solution;

(c) storing the fiber in a closed container for a period of about 8 hours to about 24 hours;

(d) removing the fiber from the closed container;

(e) contacting the fiber with a dye until the fiber reaches a desired color; wherein the fiber is dyed to the desired color using up to 50% less dye by volume than required for an untreated fiber.

12. The method of claim 11, wherein after step (d), the fiber is contacted with an acid solution in an amount sufficient to maintain a pH of the fiber of below about 6.

13. The method of claim 11, wherein the fiber is dried between steps (d) and (e).

14. A method of optimizing the retention of a dye in a fiber, the method comprising the steps of (a) treating the fiber by contacting it with a solution comprising a wetting agent, caustic soda and an ammonium salt;

(b) removing the fiber from contact with the solution;

(c) extracting the fiber to a wet pickup of 65-150%;

(d) storing the fiber in a container for a period of about 8 hours to about 24 hours;

(e) dyeing the fiber.

15. The method of claim 14, wherein after step (d), the fiber is contacted with an acid in an amount sufficient to maintain a pH of below about 6.

16. A fabric comprising a fiber that has been pretreated with a solution comprising a wetting agent, an alkaline composition and an ammonium salt; the pretreatment step including storage of the fiber in a closed container for a period of about 8 to about 24 hours, wherein the fabric exhibits substantially the same shade of color using about 75% or less the amount of dye required to dye a fabric comprising an untreated fiber.

17. A method of dyeing a fabric, the method comprising the steps of:

(a) obtaining a fiber;

(b) treating the fiber by contacting the fiber with a solution comprising a wetting agent, caustic soda and an ammonium salt;

(c) knitting or weaving the treated fiber to produce the fabric; and (d) contacting the fabric with a dye to bring the fabric to a desired color; such that the amount of dye used in step (d) required to bring the fabric to the desired color is at least about 25% less than the amount of dye required to treat a sample of the same fabric untreated.

* * * * *